US011443703B2

(12) United States Patent
Wu

(10) Patent No.: US 11,443,703 B2
(45) Date of Patent: Sep. 13, 2022

(54) METHOD FOR DRIVING DISPLAY DEVICE

(71) Applicant: HIMAX TECHNOLOGIES LIMITED, Tainan (TW)

(72) Inventor: Tung-Ying Wu, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/125,977

(22) Filed: Dec. 17, 2020

(65) Prior Publication Data

US 2022/0199043 A1 Jun. 23, 2022

(51) Int. Cl.
*G09G 3/34* (2006.01)
*G09G 3/20* (2006.01)

(52) U.S. Cl.
CPC ..... *G09G 3/3426* (2013.01); *G09G 3/2007* (2013.01); *G09G 2320/0646* (2013.01); *G09G 2360/16* (2013.01)

(58) Field of Classification Search
CPC ..... G09G 3/2007; G09G 3/3406–3426; G09G 2320/0646; G09G 2360/16
See application file for complete search history.

(56) References Cited

U.S. PATENT DOCUMENTS 8,648,886 B2 * 2/2014 Baek ..... G09G 3/3426 345/690
8,982,035 B2 * 3/2015 Seo ..... G09G 3/3611 348/467
2018/0090082 A1 3/2018 Zhang

FOREIGN PATENT DOCUMENTS

CN 105118474 A 12/2015
TW 201106333 A 2/2011
WO 2016/183890 A1 11/2016

* cited by examiner

*Primary Examiner* — Gene W Lee
(74) *Attorney, Agent, or Firm* — CKC & Partners Co., LLC

(57) ABSTRACT

A device for driving a backlight assembly of a display device includes: a block division unit for dividing the input image into plural blocks and a duty cycle determination unit. The duty cycle determination unit is used for: generating a histogram of gray levels of pixels of each block; obtaining a high gray level and a median gray level of each block according to the histogram; obtaining a high gray quantity based on the high gray level and a median gray quantity of the median gray level of each block according to the histogram; obtaining a weight value of each block according to the high gray level, the high gray quantity, the median gray quantity, and a lookup table; and calculating a duty cycle of a driving signal of each block according to the weight value, the high gray level, and the median gray level.

13 Claims, 9 Drawing Sheets

| Lookup Table | | (Q_HGL)/(Q_Mean)*255 | | | | | | | | | | | | | | | | |
|---|---|---|---|---|---|---|---|---|---|---|---|---|---|---|---|---|---|---|
| | | 0 | 16 | 32 | 48 | 64 | 80 | 96 | 112 | 128 | 144 | 160 | 176 | 192 | 208 | 224 | 240 | 255 |
| HGL | 0 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 | 0.00 |
| | 16 | 0.00 | 0.10 | 0.11 | 0.13 | 0.20 | 0.26 | 0.33 | 0.40 | 0.46 | 0.53 | 0.60 | 0.67 | 0.73 | 0.80 | 0.87 | 0.93 | 1.00 |
| | 32 | 0.00 | 0.15 | 0.17 | 0.19 | 0.25 | 0.31 | 0.38 | 0.44 | 0.50 | 0.56 | 0.63 | 0.69 | 0.75 | 0.81 | 0.88 | 0.94 | 1.00 |
| | 48 | 0.00 | 0.21 | 0.23 | 0.25 | 0.30 | 0.36 | 0.42 | 0.48 | 0.54 | 0.59 | 0.65 | 0.71 | 0.77 | 0.83 | 0.88 | 0.94 | 1.00 |
| | 64 | 0.00 | 0.26 | 0.29 | 0.30 | 0.36 | 0.41 | 0.46 | 0.52 | 0.57 | 0.63 | 0.68 | 0.73 | 0.79 | 0.84 | 0.89 | 0.95 | 1.00 |
| | 80 | 0.00 | 0.31 | 0.35 | 0.36 | 0.41 | 0.46 | 0.51 | 0.56 | 0.61 | 0.66 | 0.71 | 0.75 | 0.80 | 0.85 | 0.90 | 0.95 | 1.00 |
| | 96 | 0.00 | 0.37 | 0.41 | 0.42 | 0.46 | 0.51 | 0.55 | 0.60 | 0.64 | 0.69 | 0.73 | 0.78 | 0.82 | 0.87 | 0.91 | 0.96 | 1.00 |
| | 112 | 0.00 | 0.42 | 0.47 | 0.48 | 0.52 | 0.56 | 0.56 | 0.64 | 0.68 | 0.72 | 0.76 | 0.80 | 0.84 | 0.88 | 0.92 | 0.96 | 1.00 |
| | 128 | 0.00 | 0.47 | 0.53 | 0.54 | 0.57 | 0.61 | 0.61 | 0.68 | 0.71 | 0.75 | 0.79 | 0.82 | 0.86 | 0.89 | 0.93 | 0.96 | 1.00 |
| | 144 | 0.00 | 0.53 | 0.58 | 0.59 | 0.63 | 0.66 | 0.66 | 0.72 | 0.75 | 0.78 | 0.81 | 0.84 | 0.88 | 0.91 | 0.94 | 0.97 | 1.00 |
| | 160 | 0.00 | 0.58 | 0.64 | 0.65 | 0.68 | 0.71 | 0.71 | 0.76 | 0.79 | 0.81 | 0.84 | 0.87 | 0.89 | 0.92 | 0.95 | 0.97 | 1.00 |
| | 176 | 0.00 | 0.63 | 0.70 | 0.71 | 0.73 | 0.75 | 0.75 | 0.80 | 0.82 | 0.84 | 0.87 | 0.89 | 0.91 | 0.93 | 0.96 | 0.98 | 1.00 |
| | 192 | 0.00 | 0.69 | 0.76 | 0.77 | 0.79 | 0.80 | 0.80 | 0.84 | 0.86 | 0.88 | 0.89 | 0.91 | 0.93 | 0.95 | 0.96 | 0.98 | 1.00 |
| | 208 | 0.00 | 0.74 | 0.82 | 0.83 | 0.84 | 0.85 | 0.85 | 0.88 | 0.89 | 0.91 | 0.92 | 0.93 | 0.95 | 0.96 | 0.97 | 0.99 | 1.00 |
| | 224 | 0.00 | 0.79 | 0.88 | 0.88 | 0.89 | 0.90 | 0.90 | 0.92 | 0.93 | 0.94 | 0.95 | 0.96 | 0.96 | 0.97 | 0.98 | 0.99 | 1.00 |
| | 240 | 0.00 | 0.85 | 0.94 | 0.94 | 0.95 | 0.95 | 0.95 | 0.96 | 0.96 | 0.97 | 0.97 | 0.98 | 0.98 | 0.99 | 0.99 | 1.00 | 1.00 |
| | 255 | 0.00 | 0.90 | 1.00 | 1.00 | 1.00 | 1.00 | 1.00 | 1.00 | 1.00 | 1.00 | 1.00 | 1.00 | 1.00 | 1.00 | 1.00 | 1.00 | 1.00 |

FIG. 2

METHOD FOR DRIVING DISPLAY DEVICE

BACKGROUND

Field of Invention

The present invention relates to a device for driving a backlight assembly of a display device and a device for driving the display device.

Description of Related Art

The traditional backlight sources of the LCD device are at full brightness. The display of a dark frame is achieved by reducing the transmittance of liquid crystal, which has no help for reducing the power consumption. By contrast, the backlight local dimming allows the brightness of backlight source to be varied with dark and light frames, so the brightness of backlight source is reduced when a dark frame is displayed. Thus, the entire amount of power consumption of the backlight is reduced. In addition to the power consumption reduction, the backlight local dimming can also improve the frame quality of the LCD device.

A typical backlight local dimming can increase the frame contrast and reduce the power consumption, but the inappropriate backlight decision and image compensation may reduce the image quality. Therefore, it is desirable to provide an improved backlight local dimming to improve the aforementioned problems.

SUMMARY

The present invention provides a device for driving a backlight assembly of a display device. The device includes: an image receiver for receiving an input image, a block division unit for dividing the input image into plural blocks, a duty cycle determination unit for determining a duty cycle of a driving signal of each of the blocks, and a driving unit for driving the backlight assembly of the display device with the driving signal of each of the blocks. The duty cycle determination unit is used for: generating a histogram of gray levels of pixels of each of the blocks; obtaining a high gray level and a median gray level of each of the blocks according to the histogram; obtaining a high gray quantity based on the high gray level and a median gray quantity of the median gray level of each of the blocks according to the histogram; obtaining a weight value of each of the blocks according to the high gray level, the high gray quantity, the median gray quantity, and a lookup table; and calculating the duty cycle of the driving signal of each of the blocks according to the weight value, the high gray level, and the median gray level.

In accordance with one or more embodiments of the invention, in which obtaining the high gray level of each of the blocks includes: setting a quantity threshold (X); statistically analyzing top X brightest pixels of the pixels; and determining a gray level of Xth brightest pixel is the high gray level.

In accordance with one or more embodiments of the invention, the median gray level of each of the blocks is an average value of gray levels of pixels of each of the blocks.

In accordance with one or more embodiments of the invention, the high gray quantity is a number of the pixels with brightness from a maximum gray level to the high gray level.

In accordance with one or more embodiments of the invention, the weight value of each of the blocks is obtained by inputting the high gray level and a normalized value of a ratio of the high gray quantity to the median gray quantity into the lookup table.

In accordance with one or more embodiments of the invention, as the high gray level or the normalized value is greater, the weight value is greater.

In accordance with one or more embodiments of the invention, the duty cycle is a sum of a product of the high gray level and the weight value and a product of the median gray level and a difference between 1 and the weight value.

The present invention further provides a device for driving a display device. The device includes: an image receiver for receiving an input image, a block division unit for dividing the input image into plural blocks, a duty cycle determination unit, a gain value determination unit, and a compensation unit. The duty cycle determination unit is used for: generating a histogram of gray levels of pixels of each of the blocks; obtaining a high gray level and a median gray level of each of the blocks according to the histogram; calculating an image high gray level and an image median gray level of the input image according to the high gray level and the median gray level of each of the blocks; inputting a difference between the image high gray level and the image median gray level into a gain lookup table to obtain a duty gain; obtaining an updated duty cycle of a driving signal of each of the blocks according to the duty gain. The gain value determination unit is used for obtaining a gain value of each of the blocks according to the updated duty cycle. The compensation unit is used for compensating the input image by using the gain value of each of the blocks.

In accordance with one or more embodiments of the invention, in which obtaining the high gray level of each of the blocks includes: setting a quantity threshold (X); statistically analyzing top X brightest pixels of the pixels; and determining a gray level of Xth brightest pixel is the high gray level.

In accordance with one or more embodiments of the invention, the median gray level of each of the blocks is an average of gray levels of pixels of each of the blocks.

In accordance with one or more embodiments of the invention, the image high gray level is a maximum value of the high gray levels of the blocks.

In accordance with one or more embodiments of the invention, the image median gray level is an average value of the median gray levels of the blocks.

In accordance with one or more embodiments of the invention, as the difference between the image high gray level and the image median gray level is closer to 191, the duty gain is closer to 1.

In accordance with one or more embodiments of the invention, the updated duty cycle is obtaining by adding a first duty cycle to a product of the duty gain and a difference between a second duty cycle and the first duty cycle.

In accordance with one or more embodiments of the invention, the second duty cycle is not less than the first duty cycle.

In accordance with one or more embodiments of the invention, the duty cycle determination unit is further used for: obtaining a high gray quantity based on the high gray level and a median gray quantity of the median gray level of each of the blocks according to the histogram; obtaining a weight value of each of the blocks according to the high gray level, the high gray quantity, the median gray quantity, and a lookup table; and calculating a duty cycle of the driving signal of each of the blocks according to the weight value, the high gray level. The device further includes a driving unit for driving a backlight assembly of the display device with the updated duty cycle of the driving signal of each of the blocks.

In accordance with one or more embodiments of the invention, the high gray quantity is a number of the pixels with brightness from a maximum gray level to the high gray level.

In accordance with one or more embodiments of the invention, the weight value of each of the blocks is obtained by inputting the high gray level and a normalized value of a ratio of the high gray quantity to the median gray quantity into the lookup table.

In accordance with one or more embodiments of the invention, as the high gray level or the normalized value is greater, the weight value is greater.

In accordance with one or more embodiments of the invention, the duty cycle is a sum of a product of the high gray level and the weight value and a product of the median gray level and a difference between 1 and the weight value.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

FIG. 2 shows an exemplary lookup table for obtaining the weight value according to some embodiments of the present invention.

DETAILED DESCRIPTION

Specific embodiments of the present invention are further described in detail below with reference to the accompanying drawings, however, the embodiments described are not intended to limit the present invention and it is not intended for the description of operation to limit the order of implementation. Moreover, any device with equivalent functions that is produced from a structure formed by a recombination of elements shall fall within the scope of the present invention. Additionally, the drawings are only illustrative and are not drawn to actual size. The using of "first", "second", "third", etc. in the specification should be understood for identify units or data described by the same terminology, but are not referred to particular order or sequence.

A typical backlight local dimming provides an activation voltage signal modulated by a pulse width modulation (PWM) signal to power plural LEDs of a backlight assembly of a display device. For example, a LED driven by a voltage generated using a PWM signal with a duty cycle of 50% may provide a luminance that is approximately half the brightness when driven by a voltage generated using a PWM signal with a duty cycle of 100%. However, the said duty cycle of the PWM signal of the typical backlight local dimming is fixed and is determined according to the average luminance and/or the maximum luminance of gray levels of the corresponding display area of the display device. Therefore, the duty cycle determination manners of the typical backlight local dimming are lack of image content property to decide the most adaptive duty cycle.

Figure 1:
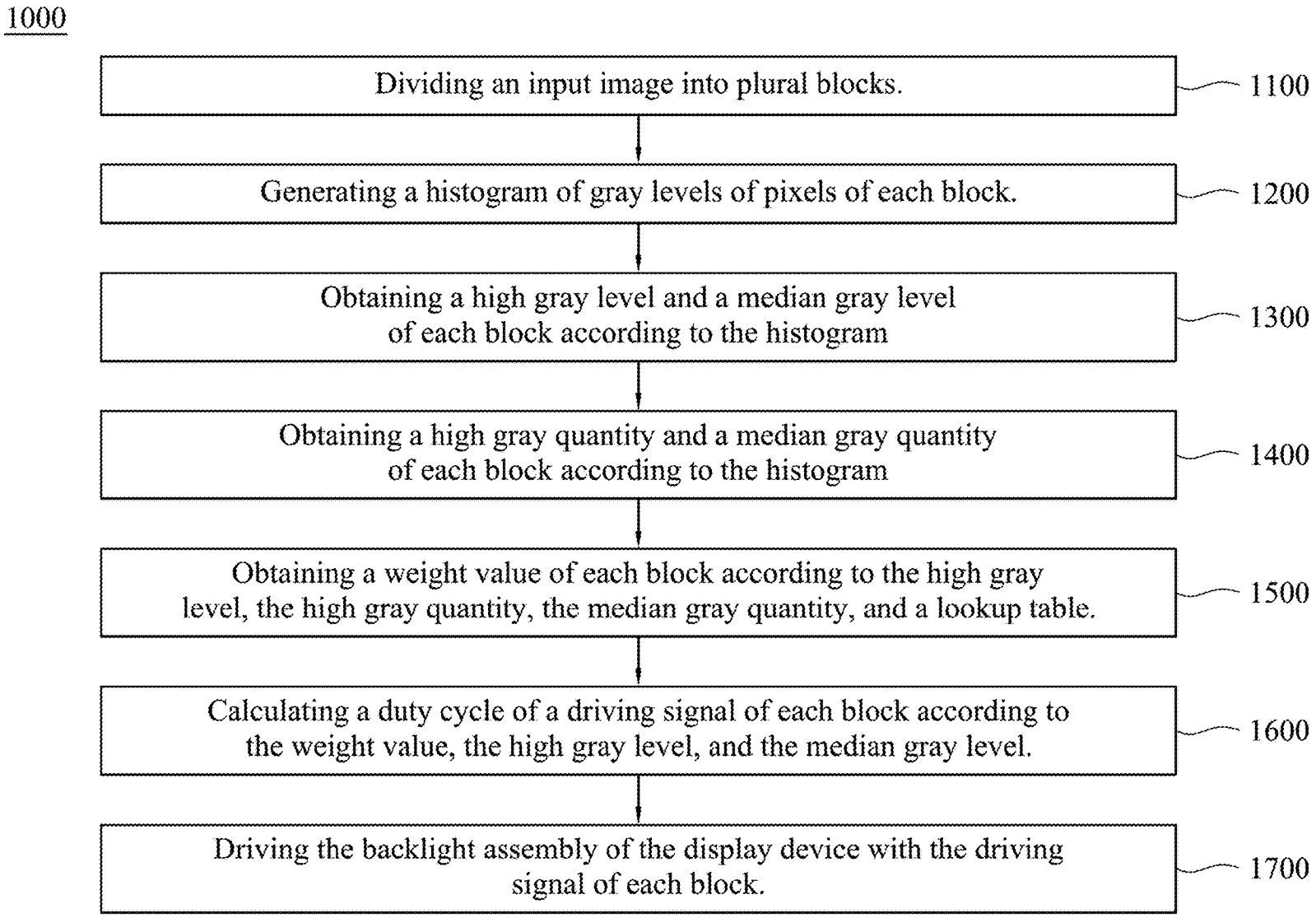
FIG. 1 illustrates a flowchart of a method for driving a backlight assembly of a display device according to some embodiments of the present invention.

FIG. 1 illustrates a flowchart of a method 1000 for driving a backlight assembly of a display device according to some embodiments of the present invention. The method 1000 includes steps 1100-1700. In step 1100, an input image is divided into plural blocks. For example, the input image with 640×320 pixels is divided into 8×4 block, and thus the pixel number of each of the blocks is 6400. It is noted that the present invention divides the input image, such that backlight local dimming could be performed.

Then, in step 1200, a histogram of gray levels of pixels of each of the blocks of the input image is generated. The said histogram shows gray level distribution of each of the blocks of the input image. Specifically, the said histogram is graphed with gray levels (from 0 gray level to 255 gray level) on the x-axis and number of pixels on the y-axis.

Then, in step 1300, a high gray level (HGL) and a median gray level (Mean) of each of the blocks are obtained according to the histogram. The median gray level (Mean) of each of the blocks is an average value of gray levels of pixels of each of the blocks.

The process for obtaining the high gray level (HGL) is: setting a quantity threshold (X); statistically analyzing top X brightest pixels of the pixels; and determining a gray level of Xth brightest pixel is the high gray level (HGL). For example, the quantity threshold (X) may be set as 64. In such case, if the number of pixels with 255 gray level is 30 and the number of pixels with 254 gray level is 40, then the gray level of the 64th brightest pixel is derived to be 254, and thus the high gray level (HGL) is 254.

Then, in step 1400, a high gray quantity (Q_HGL) based on the high gray level (HGL) and a median gray quantity (Q_Mean) of the median gray level (Mean) of each of the blocks are obtained according to the histogram. The median gray quantity (Q_Mean) is the number of pixels with the median gray level (Mean). It is worth mentioning that, if the number of pixels with the median gray level (Mean) is zero, then median gray quantity (Q_Mean) will be the non-zero number of pixels with the gray level which is closest to the median gray level (Mean). The high gray quantity (Q_HGL) is a number of the pixels with brightness from a maximum gray level to the high gray level. For example, if the high gray level (HGL) is 254, and if the number of pixels with 255 gray level is 30 and the number of pixels with 254 gray level is 40, then the high gray quantity (Q_HGL) is 70.

Then, in step 1500, a weight value (W) of each of the blocks is obtained according to the high gray level (HGL), the high gray quantity (Q_HGL), the median gray quantity (Q_Mean), and a lookup table. FIG. 2 shows an exemplary lookup table for obtaining the weight value according to some embodiments of the present invention. As shown in FIG. 2, the weight value (W) is obtained by inputting the high gray level (HGL) and a normalized value of a ratio of the high gray quantity (Q_HGL) to the median gray quantity (Q_Mean). The said normalized value is a multiplication of 255 and the ratio of the high gray quantity (Q_HGL) to the median gray quantity (Q_Mean). It is noted that if the inputted value does not match each element of the lookup table, performing linear interpolation between the two appropriate elements of the lookup table to determine the weight value (W).

Then, in step 1600, a duty cycle of a driving signal of each of the blocks is calculated according to the weight value (W), the high gray level (HGL), and the median gray level (Mean). Specifically, the duty cycle is a sum of a product of the high gray level (HGL) and the weight value (W) and a product of the median gray level (Mean) and a difference between 1 and the weight value (W). That is, the duty cycle=HGL×W+Mean×(1−W). It is noted that the duty cycle of the present invention is a normalized value. Fox example, a duty cycle of 100% is normalized to 255, and a duty cycle of 50% is normalized to 128, and so forth.

As shown in FIG. 2, as the high gray level (HGL) or the said normalized value is greater, the weight value (W) is greater. That is, when the target block corresponds to the brighter portion of the input image, then the duty cycle of the said target block is greater so as to keep the backlight to be brighter, thereby keeping image quality. As shown in FIG. 2, as the high gray level (HGL) or the said normalized value is lesser. That is, when the target block corresponds to the darker portion of the input image, then the duty cycle of the said target block is decreased so as to let the backlight to be darker, thereby reducing the leakage power. Specifically, the present invention is configured to determine an adaptive duty cycle of the driving signal of each of the blocks for local dimming so as to keep image quality meanwhile power saving.

Example 1 the high gray level (HGL)=255, the median gray level (Mean)=80, the high gray quantity (Q_HGL)=64, and the median gray quantity (Q_Mean)=190. Accordingly, the said normalized value=64/190×255=85, and thus the weight value (W)=1. Therefore, the duty cycle=255×1+80×(1−1)=255, so as to keep brightness, thereby keeping image quality.

Example 2 the high gray level (HGL)=180, the median gray level (Mean)=48, the high gray quantity (Q_HGL)=180, and the median gray quantity (Q_Mean)=300. Accordingly, the said normalized value=180/300×255=153, and thus the weight value (W)=0.85. Therefore, the duty cycle=180×0.85+48×(1−0.85)=160, so as to reduce the leakage power, thereby saving power.

Example 3 the high gray level (HGL)=100, the median gray level (Mean)=32, the high gray quantity (Q_HGL)=64, and the median gray quantity (Q_Mean)=640. Accordingly, the said normalized value=64/640×255=26, and thus the weight value (W)=0.45. Therefore, the duty cycle=100×0.45+32×(1−0.45)=63, so as to reduce the leakage power, thereby saving power.

Finally, in step 1700, the backlight assembly of the display device is driven with the driving signal of each of the blocks. For example, if the duty cycle of the driving signal of one of the blocks is calculated as 255, then the LEDs of the backlight assembly which correspond to the one of the blocks are driven for providing full brightness. For example, if the duty cycle of the driving signal of one of the blocks is calculated as 128, then the LEDs of the backlight assembly which correspond to the one of the blocks are driven for providing brightness that is approximately half the full brightness.

Figure 3:
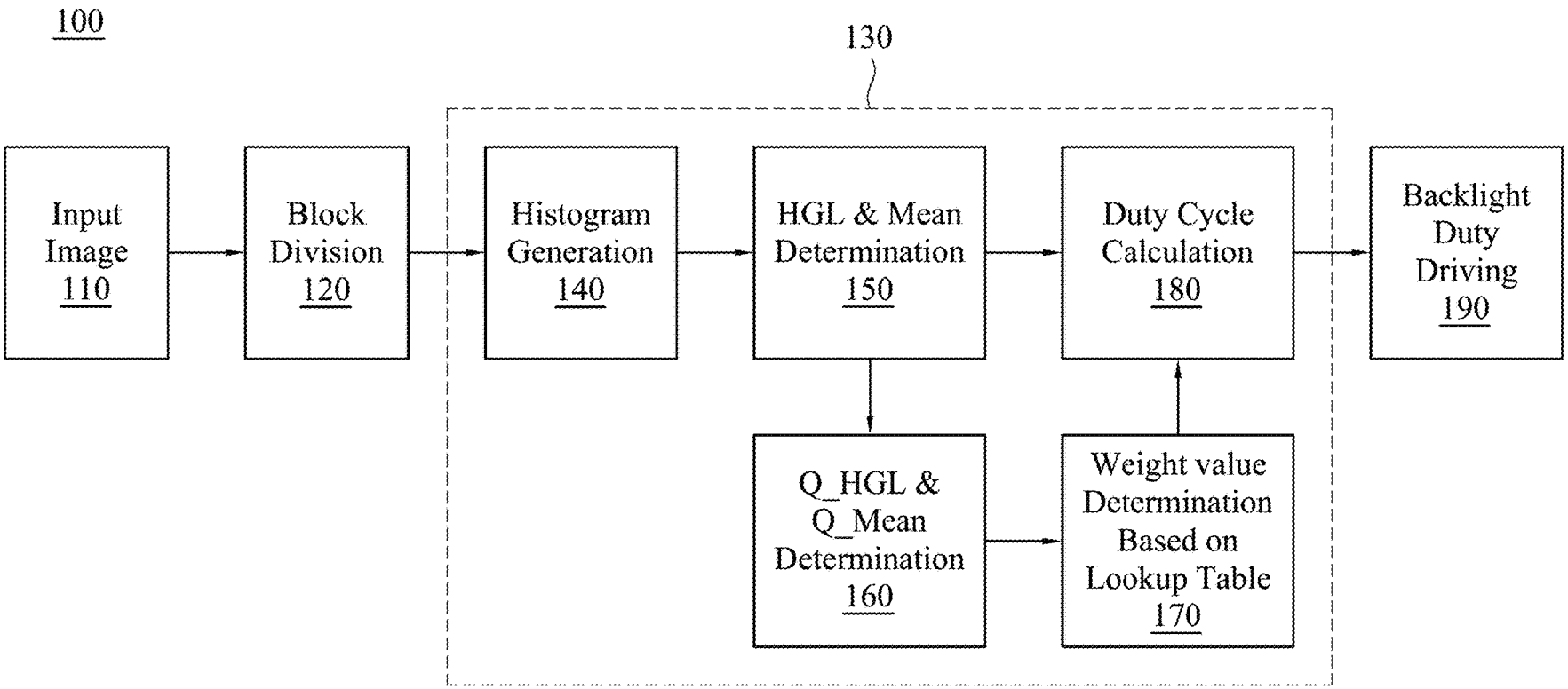
FIG. 3 illustrates a block diagram of a device for driving the backlight assembly of the display device according to some embodiments of the present invention.

FIG. 3 illustrates a block diagram of a device 100 for driving the backlight assembly of the display device according to some embodiments of the present invention. The device 100 corresponds to the method 1000 and the device 100 includes an image receiver 110, a block division unit 120, a duty cycle determination unit 130, and a driving unit 190. The image receiver 110 is used for receiving an input image. The block division unit 120 is configured to divide the input image into plural blocks, as aforementioned discussed in step 1100 of method 1000. The duty cycle determination unit 130 is configured to determine the duty cycle of the driving signal of each of the blocks, as aforementioned discussed in steps 1200-1600 of method 1000. The duty cycle determination unit 130 includes functional blocks 140-180. In functional block 140, a histogram of gray levels of pixels of each of the blocks is generated, as aforementioned discussed in step 1200 of method 1000. In functional block 150, the high gray level (HGL) and the median gray level (Mean) of each of the blocks are determined, as aforementioned discussed in step 1300 of method 1000. In functional block 160, the high gray quantity (Q_HGL) and the median gray quantity (Q_Mean) of each of the blocks are determined, as aforementioned discussed in step 1400 of method 1000. In functional block 170, the weight value (W) of each of the blocks is determined based on the lookup table, as aforementioned discussed in step 1500 of method 1000. In functional block 180, the duty cycle of the driving signal of each of the blocks is calculated, as aforementioned discussed in step 1600 of method 1000. The driving unit 190 is configured to drive the backlight assembly of the display device by the driving signal with the duty cycle of each of the blocks, as aforementioned discussed in step 1700 of method 1000.

Figure 4:
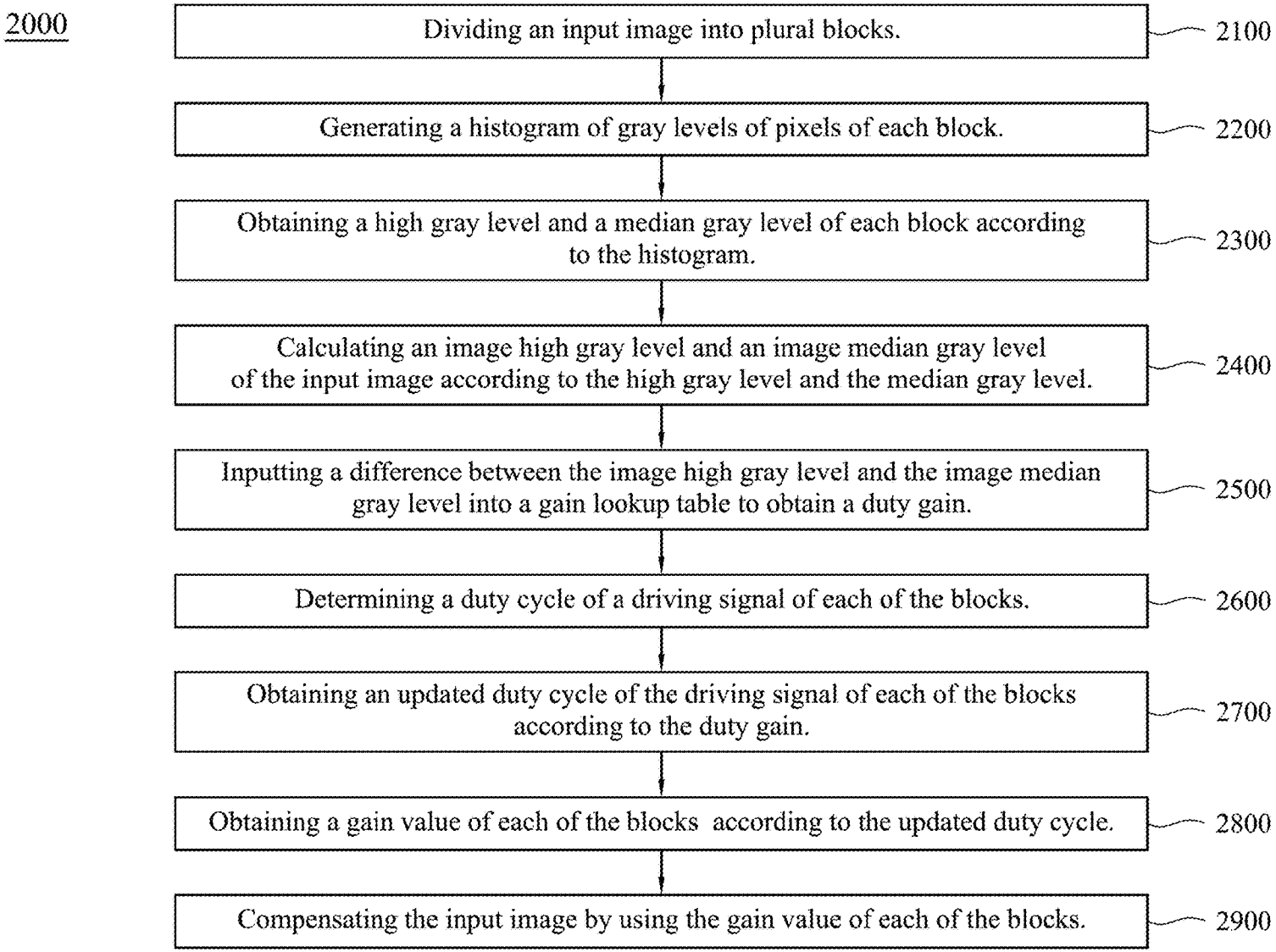
FIG. 4 illustrates a flowchart of a method for driving a display device according to some embodiments of the present invention.

FIG. 4 illustrates a flowchart of a method 2000 for driving a display device according to some embodiments of the present invention. The method 2000 includes steps 2100-2900. In step 2100, an input image is divided into plural blocks.

Then, in step 2200, a histogram of gray levels of pixels of each of the blocks of the input image is generated. The said histogram shows gray level distribution of each of the blocks of the input image. Specifically, the said histogram is graphed with gray levels (from 0 gray level to 255 gray level) on the x-axis and number of pixels on the y-axis.

Then, in step 2300, a high gray level (HGL) and a median gray level (Mean) of each of the blocks are obtained according to the histogram. The median gray level (Mean) of each of the blocks is an average value of gray levels of pixels of each of the blocks. The process for obtaining the high gray level (HGL) is: setting a quantity threshold (X); statistically analyzing top X brightest pixels of the pixels; and determining a gray level of Xth brightest pixel is the high gray level (HGL).

Then, in step 2400, an image high gray level (HGL_image) and an image median gray level (Mean_image) of the input image is calculated according to the high gray level (HGL) and the median gray level (Mean) of each of the blocks. The image high gray level (HGL_image) is a maximum value of the high gray levels (HGL) of the blocks. The image median gray level (Mean_image) is an average value of the median gray levels (Mean) of the blocks.

Figure 5:
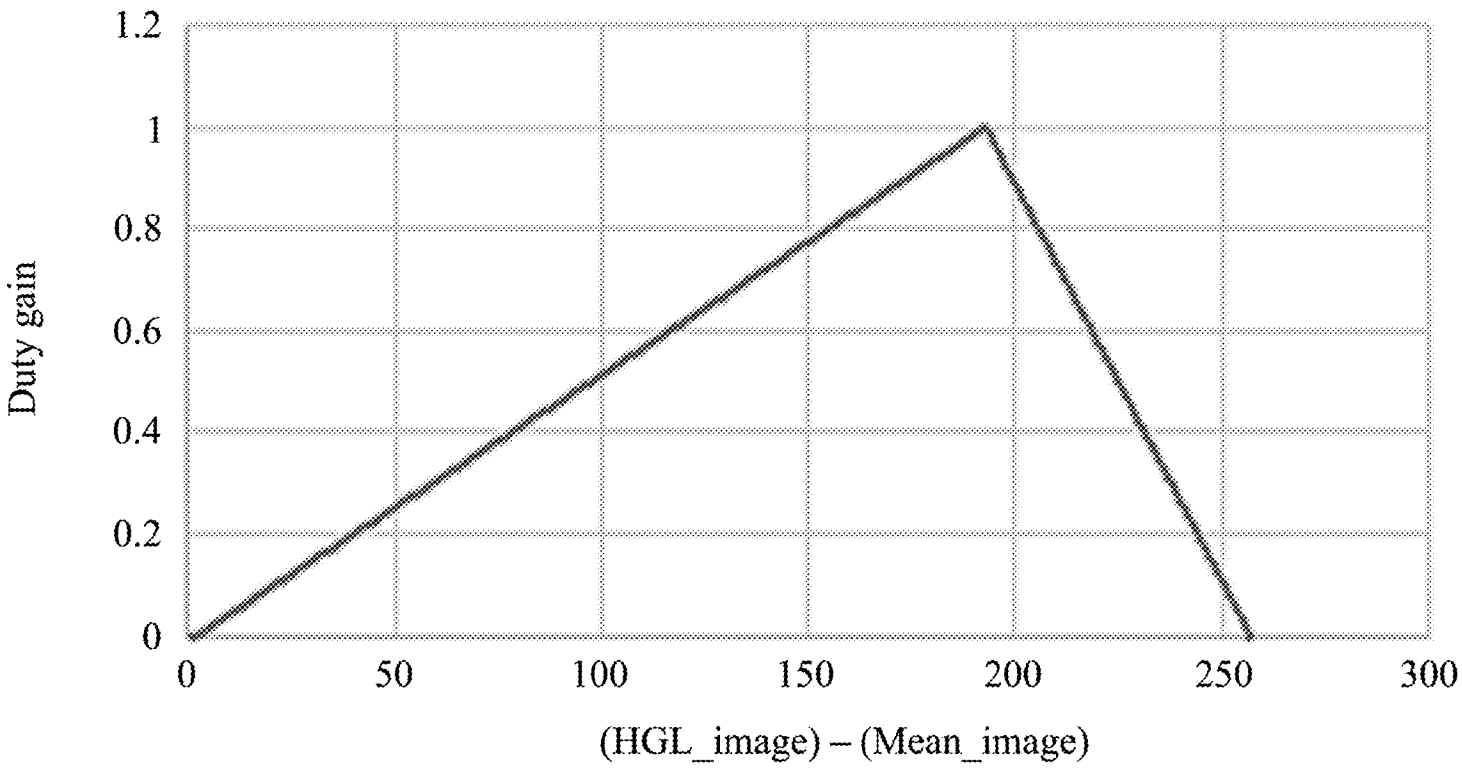
FIG. 5 shows an exemplary graphic gain lookup table for obtaining the duty gain according to some embodiments of the present invention.

Then, in step 2500, a difference between the image high gray level (HGL_image) and the image median gray level (Mean_image) is inputted into a gain lookup table to obtain a duty gain. FIG. 5 shows an exemplary graphic gain lookup table for obtaining the duty gain according to some embodiments of the present invention. As shown in FIG. 5, the said graphic gain lookup table is graphed with the input value (i.e., the difference between the image high gray level (HGL_image) and the image median gray level (Mean_image)) on the x-axis and the output duty gain on the y-axis. For example, if the difference between the image high gray level (HGL_image) and the image median gray level (Mean_image) is 176, then the corresponding duty gain is 0.92. As shown in FIG. 5, as the difference between the image high gray level (HGL_image) and the image median gray level (Mean_image) is closer to 191, the duty gain is closer to 1.

Then, in step 2600, a duty cycle of a driving signal of each of the blocks is determined. The said duty cycle of the driving signal of each of the blocks may be determined by adopting steps 1200-1600 of method 1000. In addition, the said duty cycle of the driving signal of each of the blocks may be determined by a known manner, that is, the said duty cycle of the driving signal of each of the blocks is determined based on the average luminance and/or the maximum luminance of gray levels of the corresponding block.

Then, in step 2700, an updated duty cycle of a driving signal of each of the blocks is obtained according to the duty gain. The updated duty cycle is obtaining by adding a first duty cycle to a product of the duty gain and a difference between a second duty cycle and the first duty cycle. The second duty cycle is not less than the first duty cycle. For example, the first duty cycle is 64, the second duty cycle is 157, and the duty gain is 0.92, then the updated duty cycle is $(157-64)\times0.92+64=150$. For example, the first duty cycle is 120, the second duty cycle is 151, and the duty gain is 0.65, then the updated duty cycle is $(151-120)\times0.65+120=140$.

Figure 6:
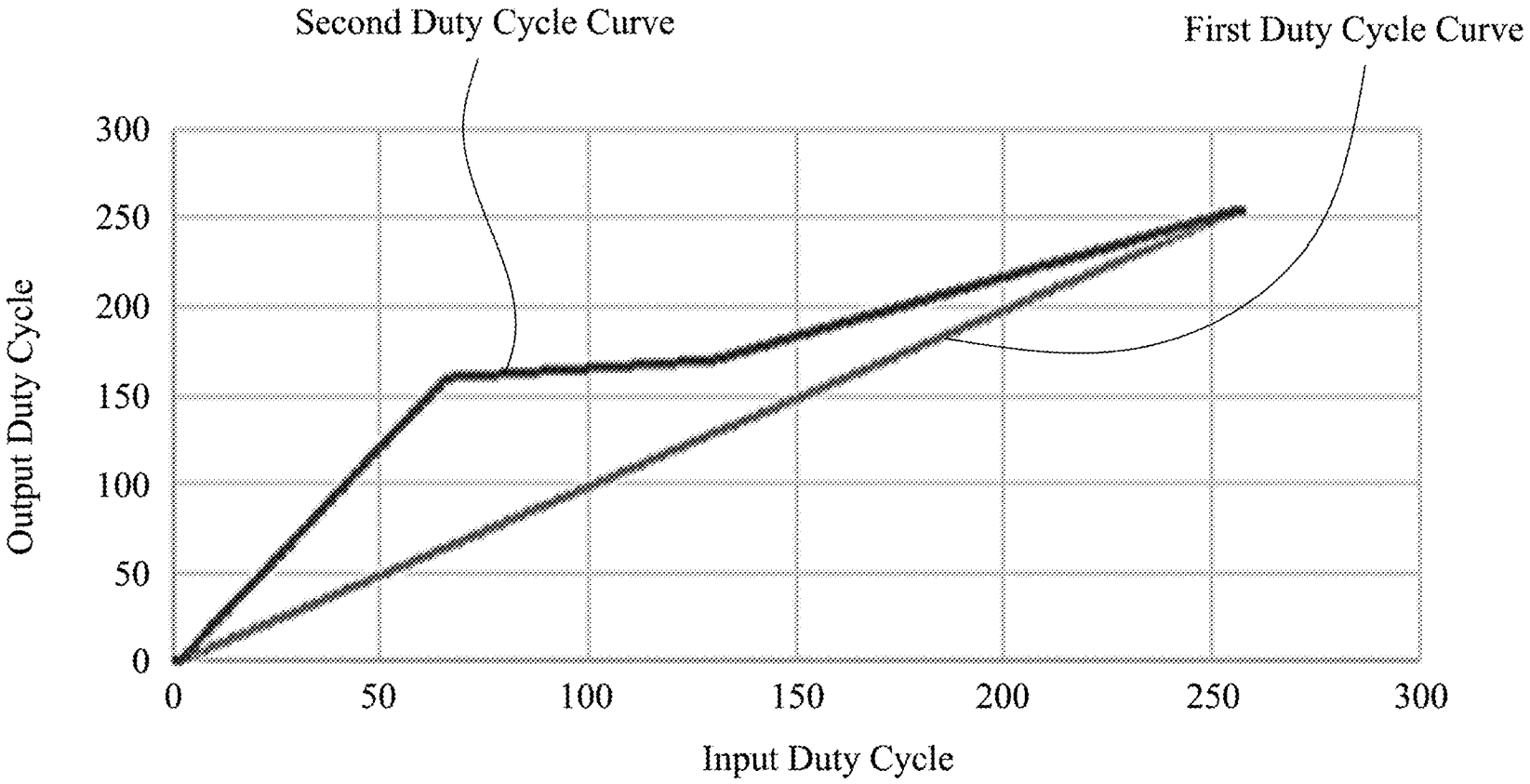
FIG. 6 illustrates a first duty cycle curve and a second duty cycle curve according to some embodiments of the present invention.

FIG. 6 illustrates a first duty cycle curve and a second duty cycle curve according to some embodiments of the present invention. The said first duty cycle in step 2700 is determined by using the first duty cycle curve in FIG. 6. The said first duty cycle curve in FIG. 6 is graphed with the input duty cycle obtained in step 2600 on the x-axis and the output first duty cycle on the y-axis. For example, if the input duty cycle obtained in step 2600 is 64, then the output first duty cycle which is utilized in step 2700 is 64. The said second duty cycle in step 2700 is determined by using the second duty cycle curve in FIG. 6. The said second duty cycle curve in FIG. 6 is graphed with the input duty cycle obtained in step 2600 on the x-axis and the output second duty cycle on the y-axis. For example, if the input duty cycle obtained in step 2600 is 64, then the output second duty cycle which is utilized in step 2700 is 157.

The said first duty cycle curve is represented to a regular linear duty cycle remapping relationship. However, the said first duty cycle curve may induce obvious halo effect due to large gray level difference. The said second duty cycle curve is represented to an adjusted duty cycle remapping relationship, specifically, the second duty cycle curve provides a greater output duty cycle for solving the halo effect, and therefore the second duty cycle curve is higher than the first duty cycle curve in FIG. 6. However, the said second duty cycle curve may enhance the leakage power of the backlight assembly of the display device.

Figure 7:
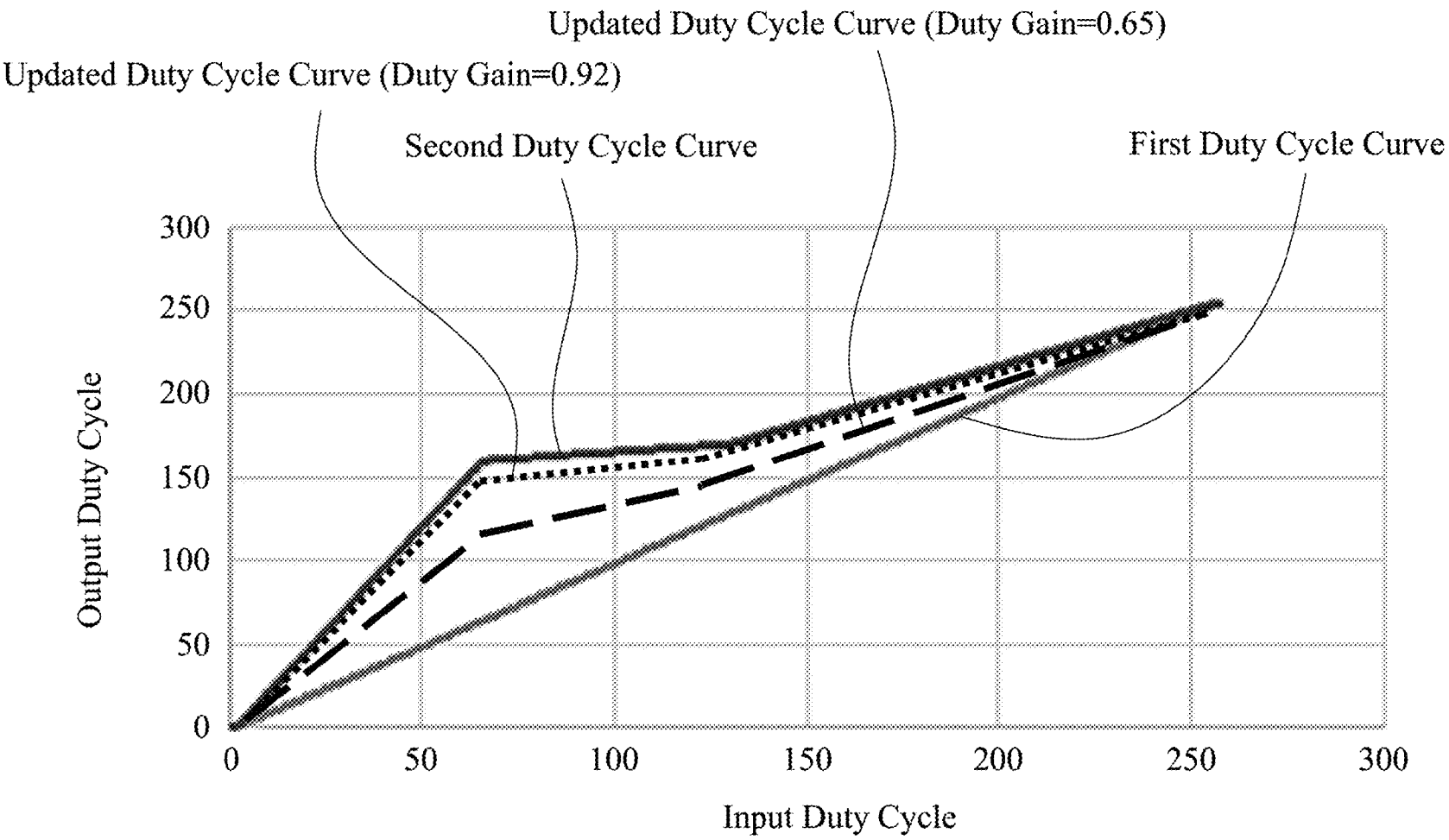
FIG. 7 illustrates two exemplary updated duty cycle curves according to some embodiments of the present invention.

FIG. 7 illustrates two exemplary updated duty cycle curves according to some embodiments of the present invention. The dotted curve represents an updated duty cycle curve with the duty gain as 0.92. The dashed dotted curve represents an updated duty cycle curve with the duty gain as 0.65. The updated duty cycle curve is higher than the first duty cycle curve (i.e., the regular duty cycle curve) so as to solve the halo effect, and the updated duty cycle curve is lower than the second duty cycle curve so as to reduce the leakage power. Specifically, the present invention provides a dynamic updated duty cycle curve to improve the halo effect meanwhile power saving.

Figure 8:
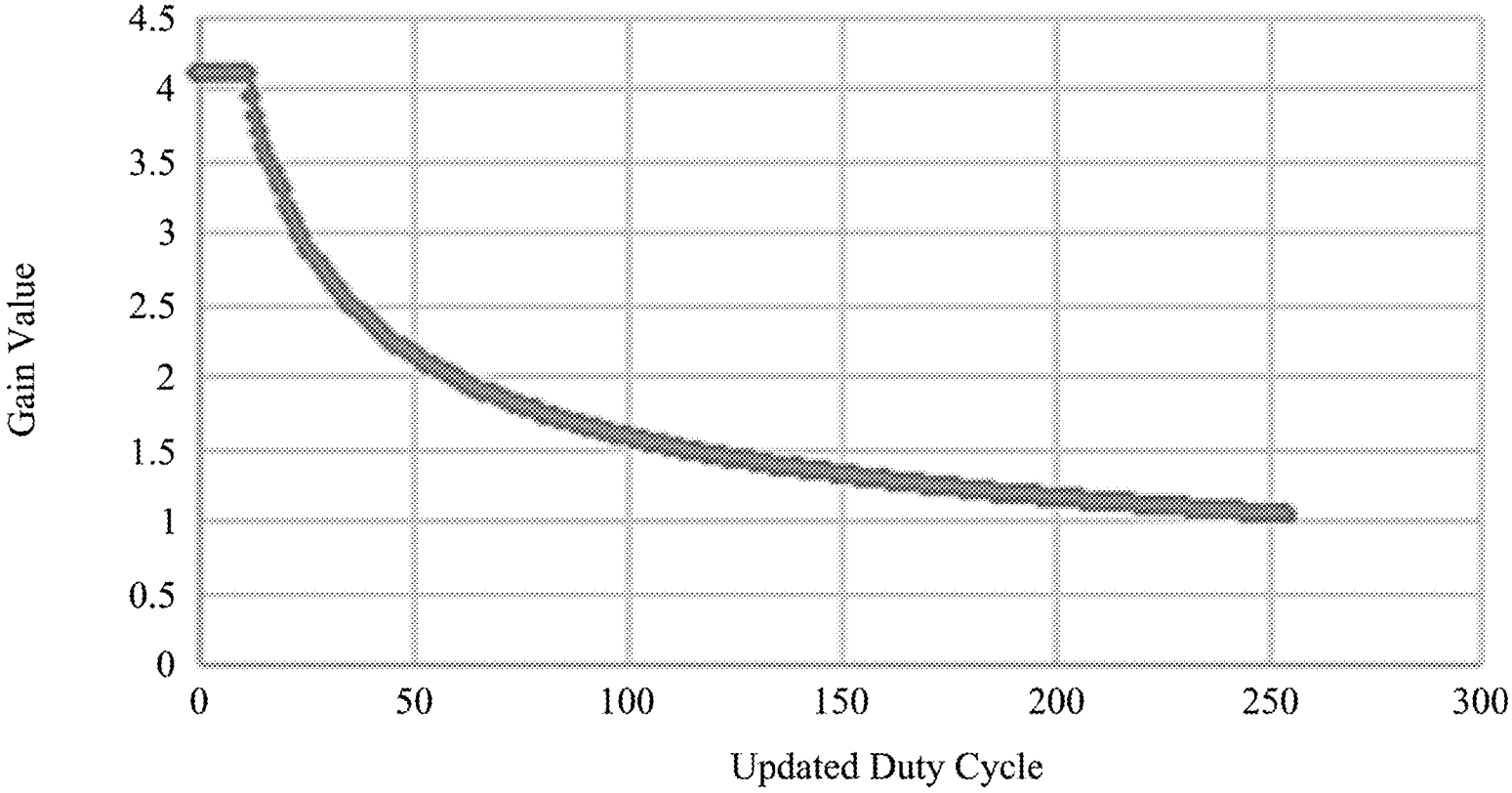
FIG. 8 illustrates an exemplary gain value curve according to some embodiments of the present invention.

Then, in step 2800, a gain value of each of the blocks is obtained according to the updated duty cycle. FIG. 8 illustrates an exemplary gain value curve according to some embodiments of the present invention. The gain value curve in FIG. 8 is graphed with the updated duty cycle obtained in step 2700 on the x-axis and the output gain value on the y-axis. For example, if the input updated duty cycle obtained in step 2700 is 150, then the output gain value in step 2800 is 1.25. For example, if the input updated duty cycle obtained in step 2700 is 140, then the output gain value in step 2800 is 1.32.

Then, in step 2900, the input image is compensated by multiplying the gain value of each of the blocks, and the backlight assembly of the display device is also driven by the driving signal with the updated duty cycle of each of the blocks, and therefore the improved backlight local dimming manner is correspondingly utilized in the display device.

Figure 9:
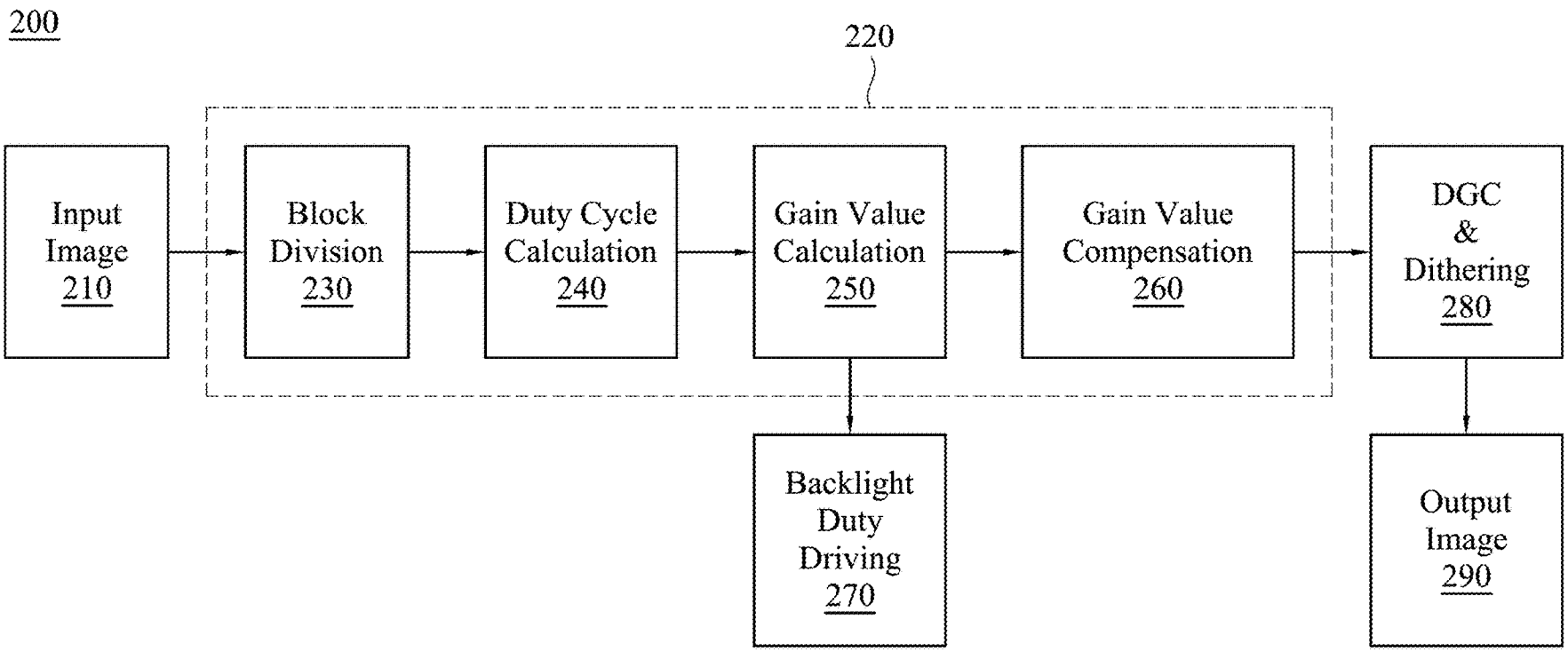
FIG. 9 illustrates a block diagram of a device for driving the display device according to some embodiments of the present invention.

FIG. 9 illustrates a block diagram of a device 200 for driving the display device according to some embodiments of the present invention. The device 200 corresponds to the method 2000 and the device 200 includes an image receiver 210, a local dimming unit 220, a driving unit 270, a DGC (digital gamma correction) and dithering unit 280, and an output unit 290. The local dimming unit 220 is configured to perform a local dimming determination process and the local dimming unit 220 includes a block division unit 230, a duty cycle determination unit 240, a gain value calculation unit 250, and a compensation unit 260. The image receiver 210 is used for receiving an input image. The block division unit 230 is configured to divide the input image into plural blocks, as aforementioned discussed in step 2100 of method 2000. The duty cycle determination unit 240 is configured to calculate a duty cycle of a driving signal of each of the blocks, as aforementioned discussed in steps 2200-2700 of method 2000. The gain value determination unit 250 is configured to calculate a gain value of each of the blocks, as aforementioned discussed in step 2800 of method 2000. The compensation unit 260 is configured to compensate the input image by multiplying the gain value of each of the blocks, as aforementioned discussed in step 2900 of method 2000. The driving unit 270 is configured to drive the backlight assembly of the display device by the driving signal with the updated duty cycle of each of the blocks. The DGC and dithering unit 280 is configured to perform a DGC (digital gamma correction) process and a dithering process. The output unit 290 is configured to output an output image to the display device, thereby displaying the displayed image on the display device.

From the above description, the present invention provides the method 1000 for driving the backlight assembly of the display device so as to keep image quality meanwhile power saving, the present invention further provides the method 2000 for driving the display device so as to improve the halo effect meanwhile power saving.

Although the present invention has been described in considerable detail with reference to certain embodiments thereof, other embodiments are possible. Therefore, the spirit and scope of the appended claims should not be limited to the description of the embodiments contained herein. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A method for driving a display device, comprising:
receiving an input image;
dividing the input image into a plurality of blocks;
generating a histogram of gray levels of pixels of each of the blocks;
obtaining a high gray level and a median gray level of each of the blocks according to the histogram;
calculating an image high gray level and an image median gray level of the input image according to the high gray level and the median gray level of each of the blocks;
inputting a difference between the image high gray level and the image median gray level into a gain lookup table to obtain a duty gain;
obtaining an updated duty cycle of a driving signal of each of the blocks according to the duty gain;
obtaining a gain value of each of the blocks according to the updated duty cycle; and
compensating the input image by using the gain value of each of the blocks.

2. The method of claim 1, wherein obtaining the high gray level of each of the blocks comprises:
setting a quantity threshold (X);
statistically analyzing top X brightest pixels of the pixels; and
determining a gray level of Xth brightest pixel is the high gray level.

3. The method of claim 1, wherein the median gray level of each of the blocks is an average of gray levels of pixels of each of the blocks.

4. The method of claim 1, wherein the image high gray level is a maximum value of the high gray levels of the blocks.

5. The method of claim 1, wherein the image median gray level is an average value of the median gray levels of the blocks.

6. The method of claim 1, wherein as the difference between the image high gray level and the image median gray level is closer to 191, the duty gain is closer to 1.

7. The method of claim 1, wherein the updated duty cycle is obtaining by adding a first duty cycle to a product of the duty gain and a difference between a second duty cycle and the first duty cycle.

8. The method of claim 7, wherein the second duty cycle is not less than the first duty cycle.

9. The method of claim 1, further comprising:
obtaining a high gray quantity based on the high gray level and a median gray quantity of the median gray level of each of the blocks according to the histogram;
obtaining a weight value of each of the blocks according to the high gray level, the high gray quantity, the median gray quantity, and a lookup table;
calculating a duty cycle of the driving signal of each of the blocks according to the weight value, the high gray level, and the median gray level; and
driving a backlight assembly of the display device with the updated duty cycle of the driving signal of each of the blocks.

10. The method of claim 9, wherein the high gray quantity is a number of the pixels with brightness from a maximum gray level to the high gray level.

11. The method of claim 9, wherein the weight value of each of the blocks is obtained by inputting the high gray level and a normalized value of a ratio of the high gray quantity to the median gray quantity into the lookup table.

12. The method of claim 11, wherein as the high gray level or the normalized value is greater, the weight value is greater.

13. The method of claim 9, wherein the duty cycle is a sum of a product of the high gray level and the weight value and a product of the median gray level and a difference between 1 and the weight value.

* * * * *